US006571694B1

(12) United States Patent
Gustafsson

(10) Patent No.: US 6,571,694 B1
(45) Date of Patent: Jun. 3, 2003

(54) DEVICE FOR STACKING AND COMPRESSING SOFT ELEMENTS

(76) Inventor: Glenn Gustafsson, Munkegärdesgatan 99, SE-442 41 Kungälv (SE)

( * ) Notice: Subject to any disclaimer, the term of this patent is extended or adjusted under 35 U.S.C. 154(b) by 0 days.

(21) Appl. No.: 09/913,646

(22) PCT Filed: Feb. 22, 2000

(86) PCT No.: PCT/SE00/00349

§ 371 (c)(1),
(2), (4) Date: Nov. 16, 2001

(87) PCT Pub. No.: WO00/50224

PCT Pub. Date: Aug. 31, 2000

(30) Foreign Application Priority Data

Feb. 22, 1999 (SE) ..... 9900599

(51) Int. Cl.[7] ..... B30B 5/04

(52) U.S. Cl. ..... 100/151; 100/215; 100/218; 100/3

(58) Field of Search ..... 100/144, 151, 100/215, 218, 220, 3, 45, 18; 414/793.7; 271/213

(56) References Cited

U.S. PATENT DOCUMENTS 3,921,826 A * 11/1975 Rice et al. ..... 414/793.7
3,977,155 A * 8/1976 Spaulding ..... 53/500
4,501,107 A 2/1985 Piotrowski
4,547,112 A * 10/1985 Steinhart ..... 414/788.3
4,902,184 A * 2/1990 Fritz ..... 414/790.3

FOREIGN PATENT DOCUMENTS

| | | | |
|---|---|---|---|
| DE | 3736868 | * | 5/1989 |
| EP | 0 248 576 A1 | | 12/1987 |
| EP | 0 670 266 A1 | | 9/1995 |
| JP | 6151418 | * | 3/1986 |

* cited by examiner

*Primary Examiner*—Allen Ostrager
*Assistant Examiner*—Shelley Self
(74) *Attorney, Agent, or Firm*—Burns, Doane, Swecker & Mathis, LLP

(57) ABSTRACT

The claimed invention relates to a device for stacking and compressing a plurality of soft elements. One purpose of the invention is to avoid damage to the soft elements due to excessive pressure. The device comprises a stacking shaft, drive means and movable receiving means arranged on two opposite sides of the stacking shaft, which receiving means in pairs are arranged in level with each other. Moveable compressing means are arranged on two opposite sides of the stacking shaft. Both the receiving means and compressing means are movable in a vertical direction. The receiving means are arranged to successively receive elements. Each pair of the compressing means is movable from above the stack for compressing the elements.

21 Claims, 4 Drawing Sheets

DEVICE FOR STACKING AND COMPRESSING SOFT ELEMENTS

FIELD OF THE INVENTION

The present invention relates generally to a device for stacking and compressing a plurality of soft elements, especially boards of fibrous insulating material, comprising a stacking shaft (14), in which the elements are capable of being stacked.

BACKGROUND ART

As a rule, equipment for wrapping insulating material is connected directly to a production line where the material is sawn and/or cut in specified sizes. This is a continuous process where the boards are usually supplied at a rate of one board per second or faster.

When wrapping pads or boards of a soft material, such as insulating material, a method has since long been applied, in which rectangular boards are stacked into a stack, compressed in the direction of stacking into a package, and then provided with a coating of a thin flexible material, such as plastic, which maintains the package in its compressed state.

According to a frequently used method, the packages are inserted in their longitudinal direction with the aid of some type of pushing means into an opening of a sack or tube of plastic, which is then possibly welded together at its open end.

According to the above method, the sides of the package are subjected, perpendicular to the direction of compression, to a mechanical pressure, which results in an unfavourable pressure gradient. There is a risk that the fibres of the material, if any, will be damaged if excessive mechanical pressure is applied to the package. This is a major problem since most insulating materials consist of fibre materials which are sensitive to pressure being applied transversely of the fibres.

Furthermore, the compressed package, while being fed, frequently passes irregularities in the conveying paths, such as bumps or gaps. These irregularities are propagated through a plurality of boards in the compressed package and result in additional pressure gradients and damage the fibres.

SUMMARY OF THE INVENTION

The object of the present invention is to provide automatic stacking and compressing, which in every respect are satisfactory, of an insulating material without the material being subjected to detrimental pressure gradients.

According to the invention, this object is achieved by a device which is of the type stated by way of introduction and which comprises receiving means comprising first drive means which are arranged on two opposite sides of the stacking shaft and to each of which at least two receiving surfaces extending along the width of the shaft are arranged, which in pairs are arranged in level with each other and are movable by said first drive means in the vertical direction of said shaft, and compressing means comprising second drive means which are arranged on two opposite sides of the stacking shaft and which are individually movable in relation to said first drive means, to each of which at least two compressing surfaces extending along the width of the shaft are arranged, so that the receiving surfaces in pairs are arranged in level with each other and are movable by said second drive means in the vertical direction of said shaft, each pair of receiving surfaces being adapted to successively receive elements, one by one, and to support the same to form a stack, and each pair of compressing surfaces being adapted to be individually movable from above in the direction of the stack, for compressing the same.

This construction renders stacking and compressing in a continuous process possible, in which the soft elements are not subjected to considerable power gradients.

The pair of receiving surfaces which supports the stack can be adapted to be gradually movable downwards as the tack grows in the vertical direction. As a result, the entire height of the shaft is utilised.

The first and second drive means may consist of elongate, flexible elements, preferably chains, which run in individually moving paths between deflecting means adjagent to the upper and lower part of the shaft, and which support said receiving surfaces and compressing surfaces, respectively, thereby forming a double paternoster-like arrangement. Preferably said first and second flexible elements run individually along an essentially common path, and said compressing surfaces and receiving surfaces are arranged alternatingly along said path. The receiving means and the compressing means each comprise preferably two pairs of receiving surfaces and two pairs of compressing surfaces.

This construction results in the receiving means being operable individually in relation to the compressing means, so that a stack can be compressed by the compressing means while at the same time a new stack can be received by the receiving means.

The device further comprises at least one first conveying means which is movable between a first deactivated position in which it is located outside the stacking shaft, and a second activated position in which it is located parallel with the compressing surfaces and contacts the upper side of the stack so as to allow, without frictional forces acting against the motion, conveyance of the stack transversely of the compressing direction.

With this discharge from the stacking area, the motion occurs without frictional forces acting on the package, which result in conventional discharge in similar situations, where, while discharging, compressing means are in contact with the material in the package and thus cause friction. Moreover, no pressing force need be applied to the package, which also normally occurs in the form of a hydraulic discharging means or the like. The compressing process according to this embodiment thus affords handling which is very gentle to the material.

Preferably, the movable conveying means consists of one or more belt conveyors which, in cooperation with a belt conveyor located under the stack, can discharge the stack. Although it is convenient for all belt conveyors to be driven, this is not necessary. Thus, for example one or more of the belt conveyors moved towards the package may have no drive and can only afford elimination of frictional forces.

According to a further embodiment of the invention, the step of compressing the stack comprises conveying of the stack between belt conveyors which are located on two opposite sides of the stack and which converge. Compressing the stack in this fashion results in a gradual compression which is gentle to the material, especially to fibrous materials.

BRIEF DESCRIPTION OF THE DRAWINGS

The present invention will now be described in more detail with reference to the accompanying drawings, which for the purpose of exemplification illustrate preferred embodiments of the invention.

DESCRIPTION OF A PREFERRED EMBODIMENT

Figure 1:
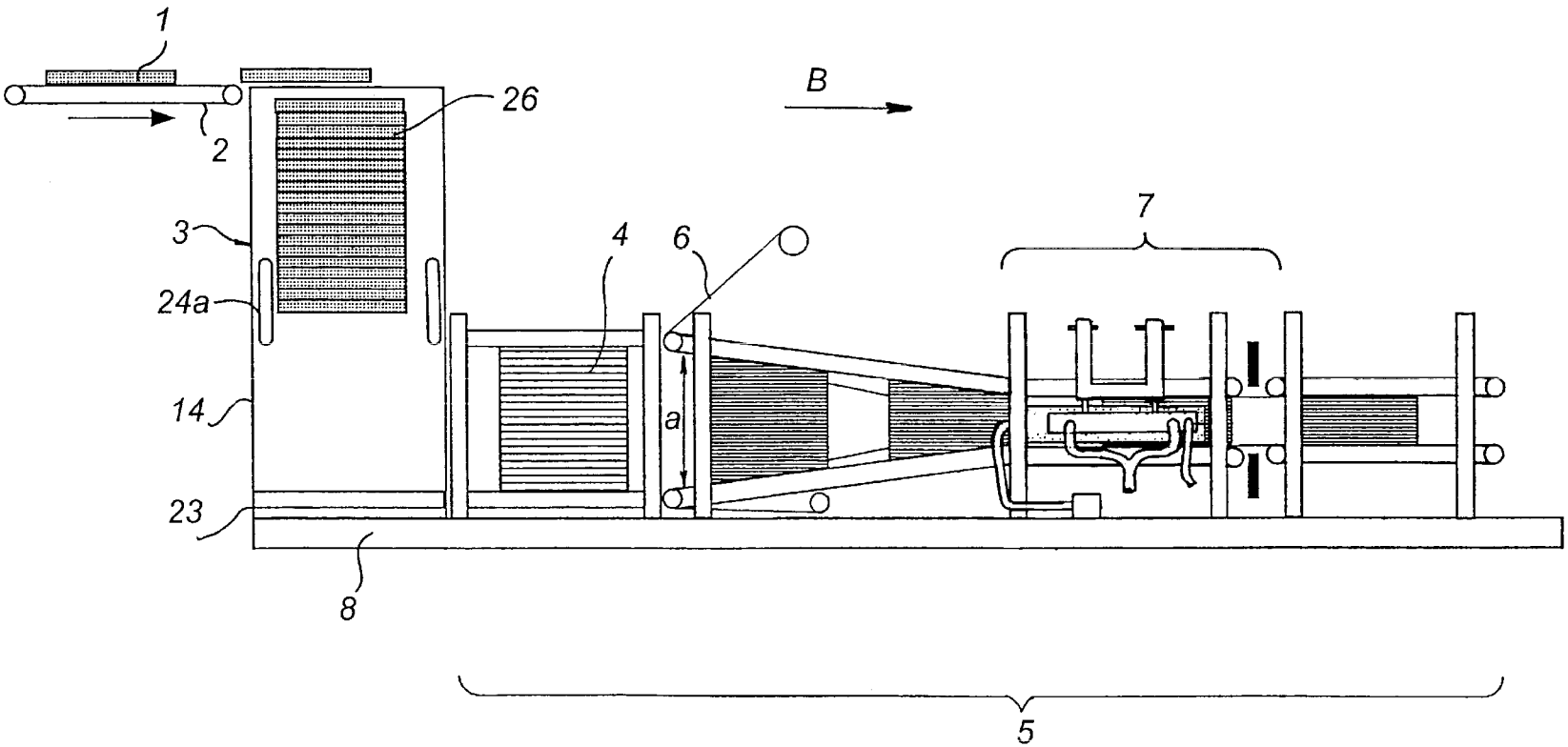
FIG. 1 is a schematic side view of a device according to the invention adapted to carry out the method according to the invention.

Wrapping of material takes place according to an embodiment of the invention along a process chain according to FIG. 1. The material, which in the example shown consists of boards 1 of a fibrous insulating material, is fed on a conveyor belt 2 to a compressing assembly 3 according to the invention where the boards are stacked and compressed. The compressed package 4 is then introduced by a feeding assembly 5 into a thin and flexible wrapping material 6 and further to a sealing arrangement 7, where the packages are sealed, first along the feeding direction and then transversely of the feeding direction. The entire device is held together by a stand 8, preferably consisting of a plurality of welded-together beams.

Figure 2:
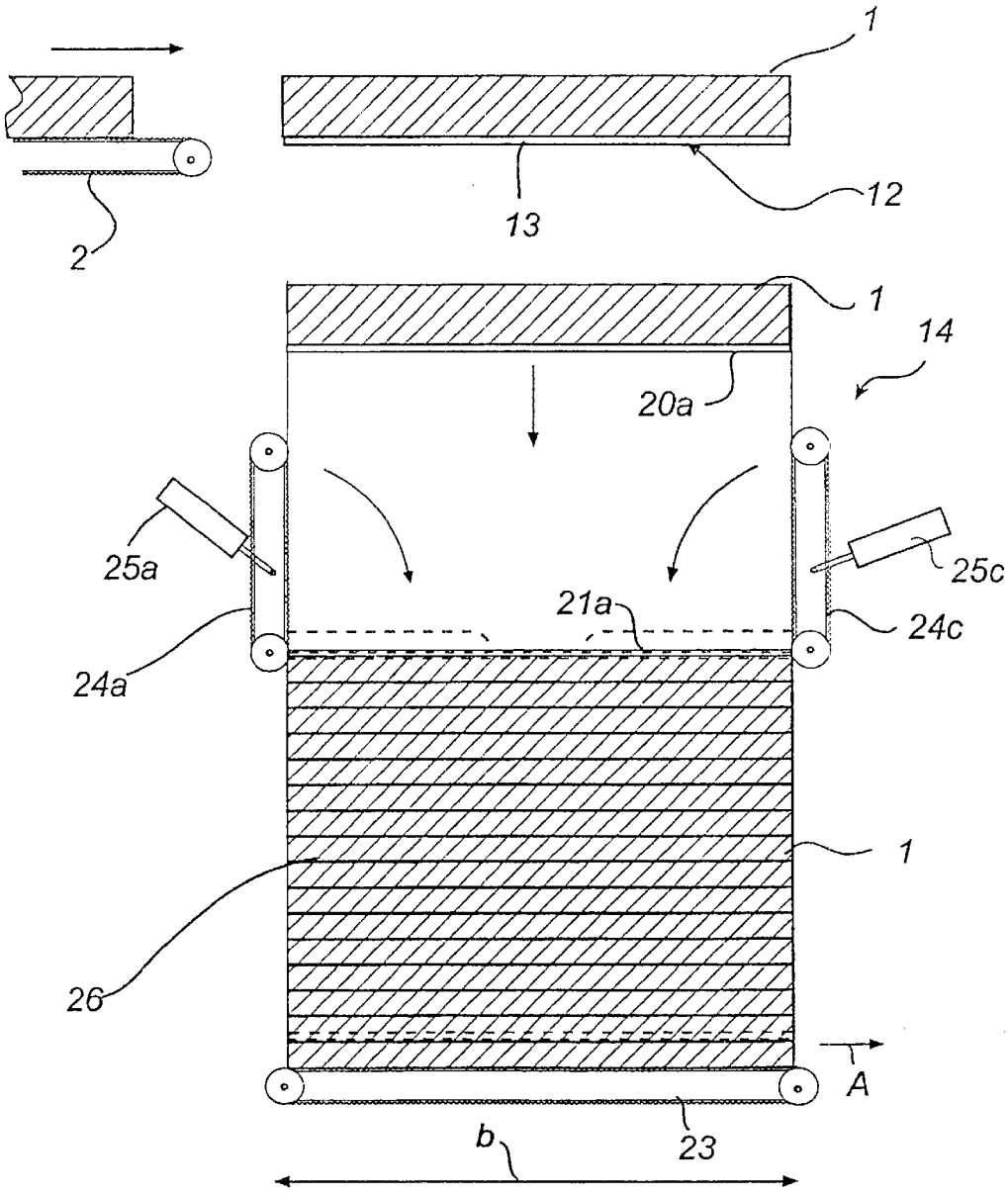
FIG. 2 is a schematic sectional side view of a compressing assembly according to the invention.
Figure 3:
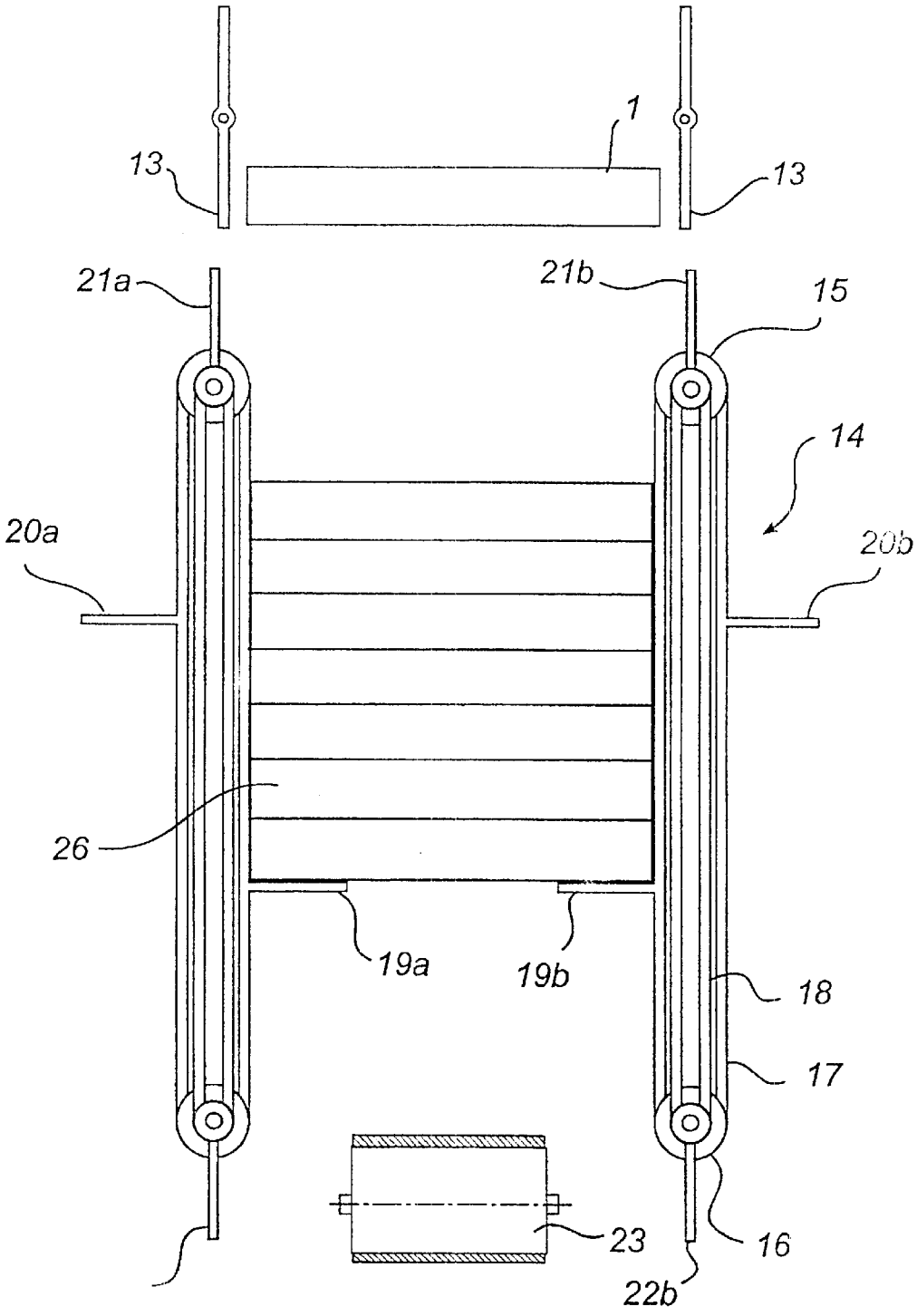
FIG. 3 is a schematic front view of the compressing assembly in FIG. 2 in a first position.
Figure 4:
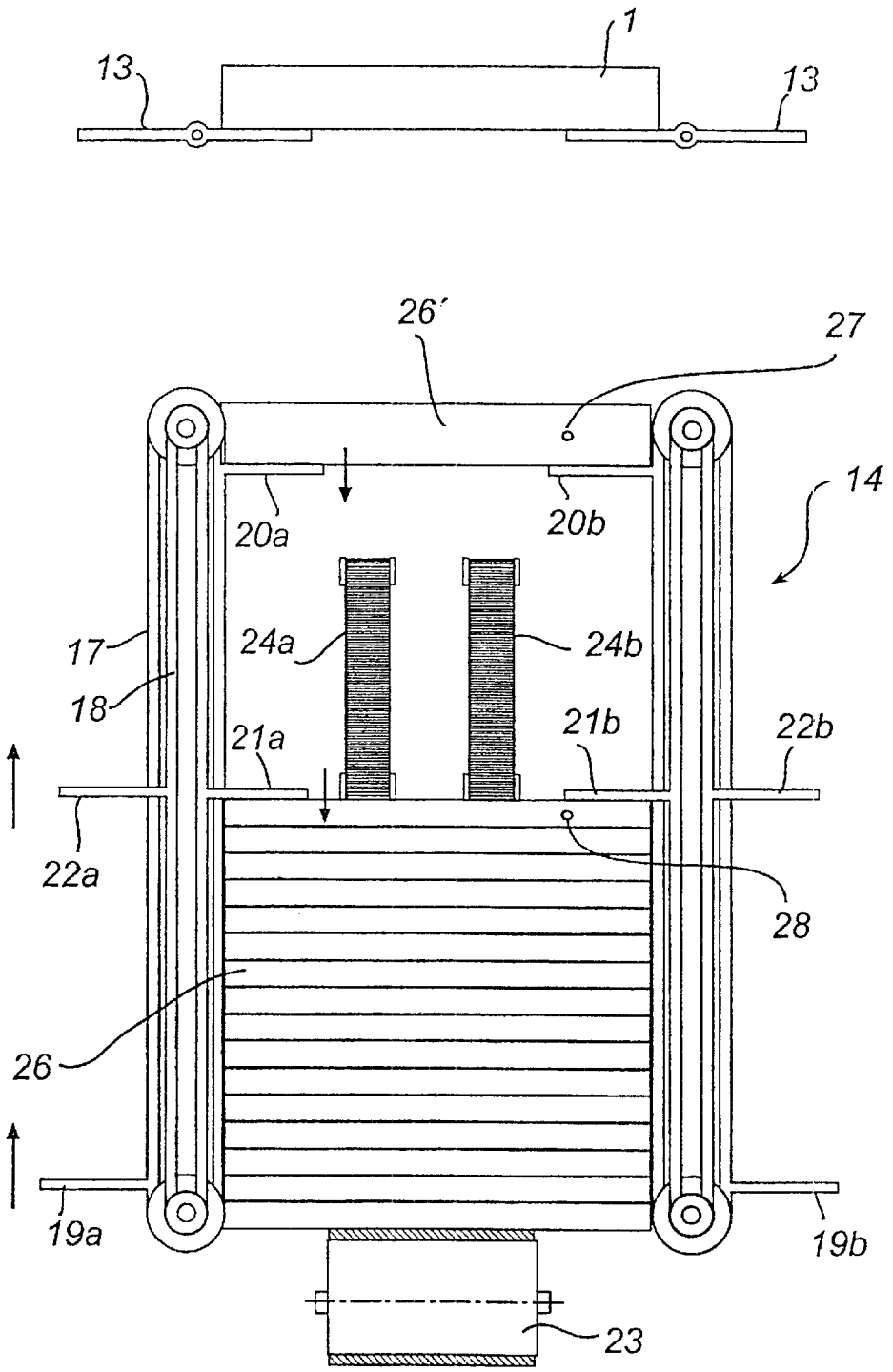
FIG. 4 is a schematic front view of the compressing assembly in FIG. 2 in a second position.

FIGS. 2–4 schematically illustrate an embodiment of the compressing assembly 3 according to the invention.

With reference to FIG. 2, numeral 2 designates a conveying path, preferably a conveyor belt, which feeds elements 1 of an insulating material to the compressing assembly. The elements can be in the form of boards and will below be referred to as boards, but could just as well have a different, essentially extended, form.

The compressing assembly has in its upper portion a loading means 12 which comprises two rotatable surfaces or blades 13. The blades 13 are movable between a horizontal position (FIG. 4), in which they support between them a board 1, and a vertical position (FIG. 3) in which they do not offer any support to the board. The loading means 12 thus operates in two strokes, the first, with the blades in the horizontal position, receiving a board 1 from the conveying path 2, and then, by turning the blades to a vertical position, letting the board 1 fall down.

Below the loading means 12 there is a stacking shaft 14 which is adapted to stack and compress boards 1. In the shown example, the shaft comprises two individually movable shelf assemblies 17, 19*a*, 19*b*, 20*a*, 20*b*, 18, 21*a*, 21*b*, 22*a*, 22*b*.

Each shelf assembly comprises drive means, such as gear-driven chains 17, 18, which run in endless paths between deflecting means 15, 16, such as gear wheels, in the upper and lower end of the shaft 14. A plurality of shelves 19–22 are arranged adjacent to the chains and extend essentially perpendicular to the extent of the chains 17, 18, and preferably transversely of two opposite sides of the shaft, along their entire width b.

The shelf assemblies thus work in a paternoster-like fashion, with shelves that are movable up and down along a chain-driven path. The paths are individually movable but have a mutually dependent pattern of motion, which will be described in more detail below.

The first shelf assembly 17, 19*a*, 19*b*, 20*a*, 20*b* is a receiving means and has in the shown example two pairs of receiving surfaces 19*a*–*b*, 20*a*–*b*, each comprising a shelf along each side of the shaft, symmetrically arranged on the same level. The two pairs of shelves 19*a*–*b*, 20*a*–*b* are advantageously arranged diametrically opposite to each other so that when a pair of shelves 19*a*–*b* is located at the very bottom of the shaft, the other pair of shelves 20*a*–*b* is located at the very top.

The second shelf assembly 18, 21*a*, 21*b*, 22*a*, 22*b* is a compressing means and has in the shown example two pairs of compressing surfaces 21*a*–*b*, 22*a*–*b*, each comprising a shelf along each side of the shaft, arranged on the same level. The two pairs of shelves 21*a*–*b*, 22*a*–*b* are advantageously arranged diametrically opposite to each other so that when one pair of shelves 21*a*–*b* is located at the very bottom of the shaft, the other pair of shelves 22*a*–*b* is located at the very top. In FIGS. 2 and 4, however, the shelves 21*a*–*b*, 22*a*–*b* are positioned approximately on the same level, one pair of shelves 21*a*–*b* being on its way down, and the other pair of shelves 22*a*–*b* being on its way up.

Below the shaft 14 there is a conveying path, such as a belt conveyor 23, which has its direction of motion A parallel with the longitudinal direction of the shelves.

Somewhere in the middle of the shaft 14 there is a conveying means 24*a*–*c* which is adapted to move at least one belt conveyor 24*a*–*c* from a position outside the shaft to a position parallel with the belt conveyor 23. In the example shown, the conveying means consists of four belt conveyors (of which only two are to be seen in FIG. 2 and FIGS. 3–4, respectively), which are arranged in pairs on the two open sides of the shaft. Each belt conveyor 24*a*–*c* is with the aid of a power means, such as a hydraulic piston 25*a*, 25*c*, movable from a vertical position (indicated by full lines in FIG. 2) to a horizontal position (indicated by dashed lines in FIG. 2).

When the loading means 12 lets a board 1 fall down from its blades 13, this board is received by one pair of shelves 19*a*–*b* of the receiving means. For each board that is received, the pair of shelves 19*a*–*b* is moved step-by-step downwards by the chains, and a new stack 26 forms gradually (see FIG. 3).

When the stack 26 consists of the desired number of boards, the pair of shelves 19*a*–*b* is moved to its bottom position, the stack 26 being transferred to the belt conveyor 23 and the pair of shelves 19*a*–*b* will be without load. The receiving means is now moved to a position in which the other pair of shelves 20*a*–*b* is prepared to receive a board 1 from the loading means 12, thereby forming a new stack 26' (see FIG. 4).

When a stack 26 has been placed on the conveying path 23, one pair of shelves 2l*a*–*b* of the compressing means is moved downwards and thereby compresses the stack 26 to the desired height. Thanks to the fact that each shelf assembly has two pairs of shelves, the loading of boards can take place essentially continuously by a new stack 26' being begun while the first stack 26 is being compressed.

The belt conveyors 24*a*–*c* are then pivoted with the aid of the power means 25*a*, 25*c* to their second horizontal position, in which they are positioned parallel with and in contact with the upper side of the stack (indicated by dashed lines in FIG. 2). The belt conveyors 24*a*–*c* thus relieve the pair of shelves 21*a*–*b* of the compressing means from the compression pressure.

The compressed stack 6 is now positioned between the belt conveyors 24*a*–*c* and the belt conveyor 23 and can be removed from the shaft by being driven by one of, or preferably all, the belt conveyors 23, 24*a*–*c*.

Controlling of the drive means 17, 18 in the correct manner so that the desired number of boards are stacked and the desired compression is obtained, and coordination of all motions are provided by sensors in suitable positions in the shaft, which transmit signals to control electronics. For example, there are sensors 27 for indicating when a board 1 has been placed on top of the stack 26, said sensor also counting the number of boards 1 in the stack 26, and sensors 28 indicating when the compressing surfaces have reached a position corresponding to the desired degree of compression, etc.

An important property of the inventive device thus is that the drive means 17, 18 are individually movable relative to each other. At the same time their patterns of motion are, of course, most dependent on each other, the position of the receiving means affecting the operation of the compressing means and vice versa.

Reference once more being made to FIG. 1, the compressed package 4 can now be conveyed by the feeding assembly 5 in a direction B. The process chain shown in FIG. 1 is only illustrated for the purpose of exemplification, and it will be appreciated that the present invention can be applied in all processes in which stacking and compressing of soft elements are performed.

It will be appreciated that the invention according to the appended claims is not restricted by the above description of preferred embodiments. The described devices can, for example, vary in respect of form as well as material, the person skilled in the art being expected to make the adaptations required by a specific situation.

What is claimed is:

1. A device for stacking and compressing a plurality of soft elements, comprising a stacking shaft 14, in which the elements are capable of being stacked, characterised by receiving means (17, 19*a–b*, 20*a–b*) comprising first drive means (17) which are arranged on two opposite sides of the stacking shaft (14) and to each of which at least two receiving surfaces (19*a–b*, 20*a–b*) extending along the width (b) of the shaft are arranged, which in pairs are arranged in level with each other and are movable by said first drive means (17) in the vertical direction of said shaft (14), and compressing means (18, 21*a–b*, 22*a–b*) comprising second drive means (18) which are arranged on two opposite sides of the stacking shaft (14) and which are individually movable in relation to said first drive means (17), to each of which at least two compressing surfaces (21*a–b*, 22*a–b*) extending along the width (b) of the shaft are arranged, so that the compressing surfaces in pairs are arranged in level with each other and are movable by said second drive means (18) in the vertical direction of said shaft (14), each pair of receiving surfaces (19*a–b*, 20*a–b*) being adapted to successively receive elements and to support the same to form a stack (26), and each pair of compressing surfaces (21*a–b*) being adapted to be individually movable from above in the direction of the stack (26), for compressing the same.

2. A device as claimed in claim 1, wherein the pair of receiving surfaces that supports the stack is adapted to be gradually movable downwards as the stack (26) grows in the vertical direction.

3. A device as claimed in claim 1, wherein said first and second drive means consist of elongate, flexible elements (17, 18), preferably chains, which run in individually moving paths between deflecting means (15, 16) adjacent to the upper and lower part of the shaft (14), and which support said receiving surfaces (19*a–b*, 20*a–b*) and compressing surfaces (21*a–b*, 22*a–b*), respectively, thereby forming a double paternoster.

4. A device as claimed in claim 3, wherein said first and second flexible elements (17, 18) run individually along an essentially common path, and wherein said compressing surfaces (21*a–b*, 22*a–b*) and receiving surfaces (19*a–b*, 20*a–b*) are arranged alternatingly along said path.

5. A device as claimed in claim 1, wherein the receiving means and the compressing means each comprise two pairs of receiving surfaces (19*a–b*, 20*a–b*) and two pairs of compressing surfaces (2l*a–b*, 22*a–b*).

6. A device as claimed in claim 1, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (21*a–b*, 22*a–b*) and contacts the upper side of the stack (26) so as to allow, without frictional forces acting against the motion, conveyance of the stack transversely of the compressing direction.

7. A device as claimed in claim 6, wherein the compressing assembly further comprises a second conveying means (23) which is located under the stack and adapted, in cooperation with the first conveying means in its activated position, to remove the compressed stack from the stacking shaft (14).

8. A device as claimed in claim 7, wherein the conveying means (24*a–c*, 23) consist of belt conveyors.

9. A device as claimed in claim 2, wherein said first and second drive means consist of elongate, flexible elements (17, 18), preferably chains, which run in individually moving paths between deflecting means (15, 16) adjacent to the upper and lower part of the shaft (14), and which support said receiving surfaces (19*a–b*, 20*a–b*) and compressing surfaces (2l*a–b*, 22*a–b*), respectively, thereby forming a double paternoster.

10. A device as claimed in claim 9, wherein said first and second flexible elements (17, 18) run individually along an essentially common path, and wherein said compressing surfaces (21*a–b*, 22*a–b*) and receiving surfaces (19*a–b*, 20*a–b*) are arranged alternatingly along said path.

11. A device as claimed in claim 2, wherein the receiving means and the compressing means each comprise two pairs of receiving surfaces (19*a–b*, 20*a–b*) and two pairs of compressing surfaces (21*a–b*, 22*a–b*).

12. A device as claimed in claim 3, wherein the receiving means and the compressing means each comprise two pairs of receiving surfaces (19*a–b*, 20*a–b*) and two pairs of compressing surfaces (2l*a–b*, 22*a–b*).

13. A device as claimed in claim 4, wherein the receiving means and the compressing means each comprise two pairs of receiving surfaces (19*a–b*, 20*a–b*) and two pairs of compressing surfaces (21*a–b*, 22*a–b*).

14. A device as claimed in claim 9, wherein the receiving means and the compressing means each comprise two pairs of receiving surfaces (19*a–b*, 20*a–b*) and two pairs of compressing surfaces (2l*a–b*, 22*a–b*).

15. A device as claimed in claim 10, wherein the receiving means and the compressing means each comprise two pairs of receiving surfaces (19*a–b*, 20*a–b*) and two pairs of compressing surfaces (21*a–b*, 22*a–b*).

16. A device as claimed in claim 2, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (2l*a–b*, 22*a–b*) and contacts the upper side of the stack (26) so as to allow, without frictional forces acting against the motion, conveyance of the stack transversely of the compressing direction.

17. A device as claimed in claim 3, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (21*a–b*, 22*a–b*) and contacts the upper side of the stack (26) so as to allow, without frictional forces acting against the motion, conveyance of the stack transversely of the compressing direction.

18. A device as claimed in claim 4, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (2 l*a–b*, 22*a–b*) and contacts the upper side of the stack (26) so as to allow, without frictional forces acting against the motion, conveyance of the stack transversely of the compressing direction.

19. A device as claimed in claim 5, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (2 l*a–b*, 22*a–b*) and contacts the upper side of the stack (26) so as to allow, without frictional forces acting against the motion, conveyance of the stack transversely of the compressing direction.

20. A device as claimed in claim 9, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (2l*a–b*, 22*a–b*) and contacts the upper side of the stack (26) so as to allow, without frictional forces acting against the motion, conveyance of the stack transversely of the compressing direction.

21. A device as claimed in claim 10, further comprising at least one first conveying means (24*a–c*) which is movable between a first conveying means (24*a–c*) which is movable between a first deactivated position in which it is located outside the stacking shaft (14),and a second activated position in which it is located parallel with the compressing surfaces (2l*a–b*, 22*a–b*) and contacts the upper side of the stack (26) so as to allow, without frictional forces acting against the motion, conveyance of the stack transversely of the compressing direction.

* * * * *